United States Patent [19]

Valleé

[11] 4,058,950

[45] Nov. 22, 1977

[54] INTEGRATED SHEET METAL ROOFING SYSTEM

[76] Inventor: Louis Léonce Valleé, 6392 Maubourg, Montreal, Quebec, Canada

[21] Appl. No.: 733,778

[22] Filed: Oct. 19, 1976

[30] Foreign Application Priority Data

Jan. 29, 1976 Canada ..... 244714

[51] Int. Cl.[2] ..... E04B 1/02

[52] U.S. Cl. ..... 52/461; 52/549

[58] Field of Search ..... 52/465, 466, 461, 462, 52/470, 520, 549, 552

[56] References Cited

U.S. PATENT DOCUMENTS

| | | | |
|---|---|---|---|
| 1,974,351 | 9/1934 | Walten et al. | 52/520 X |
| 2,408,557 | 10/1946 | Huntington | 52/466 |
| 2,855,871 | 10/1958 | Huntington | 52/461 |

*Primary Examiner*—Price C. Faw, Jr.
*Assistant Examiner*—Carl D. Friedman
*Attorney, Agent, or Firm*—Larson, Taylor and Hinds

[57] ABSTRACT

A roofing system of the batten type using sheet metal components only.

The battens are of channel section having bottom and side walls, with the side walls having spaced apart extensions at their upper edge, folded inwards to lie in a plane parallel with the plane of the bottom wall. Each of the battens is disposed on an underlying wooden roof structure and secured thereon in spaced apart parallel arrangement of screws passed through the bottom wall of the battens. Pan sections are disposed between the battens and have side walls in contact with the side walls of the battens. Extensions project from the upper edges of the pan section side walls, some of which are folded over the top edge of the side walls of the battens and others of which lie over the inwardly folded extensions of the side walls of the battens and have portions thereof folded under the said inwardly folded extensions to interlock the pan sections with the battens. Batten covering caps are slidably engaged with the interlocked battens and side walls of the pan sections.

8 Claims, 8 Drawing Figures

INTEGRATED SHEET METAL ROOFING SYSTEM

This invention relates to sheet metal roofing structures of the batten type in which the pan sections and the battens have their edge portions interlocked with each other in weathertight sealing without the use of other fasteners.

The invention is an improvement on my previous applications in Canada, Ser. Nos. 233,923; 241,047 filed on Aug. 21, 1975 and Dec. 4, 1975 respectively, and consists of battens formed from sheet metal cut and folded in generally channel form, having a bottom wall, a pair of side walls and bottom end walls, with the upper ends of the side walls having extensions whereby the upper ends of the battens on one side of a roof engage with the upper ends of battens on the other side of a roof. The top edges of the side walls have extensions which are folded inwards to partially close the open top of the formed channel. The pan sections of the roofing structure are also formed of sheet metal whose opposite side edges are folded upwards to form side walls and then folded back on themselves to form a downwardly depending strip to which a batten covering cap is secured. The upper free edge of the side walls of the pan sections are cut to form a series of closure sections, some of which are folded over the upper edges of the side walls of the battens and others of which are folded under the folded inward extensions of the side walls of the battens to securely interlock the pan sections to the battens. The battens and pan sections are secured to the underlying wood roof by means of screws passing through the bottom wall of the battens and accessible through the open spaces at the top of the battens. The open top of the battens and engaged portions of the pan sections are closed by an inverted channel cap member whose sides are slidingly engaged with the folded back portions of the side walls of the pan sections to make the whole assembly weathertight.

The primary object of the invention is to provide a sheet metal roof consisting of pan sections and battens in which edge portions of the pan sections and battens are interlocked with each other without the use of other fastening means and the combined pan sections and battens are secured to an underlying wooden roof by fastening screws passing through the bottom wall of the battens.

A further object of the invention is to provide an interlock between the pan sections and the battens which will hold these members against transverse and longitudinal movement.

A further object of the invention is to provide interlocked pan sections and battens which reinforce each other against mechanical damage and are completely weathertight.

These and other objects of the invention will be apparent from the following detailed specification and the accompanying drawings in which:

FIG. 1 is a perspective view of a portion of a roof, showing pan sections and battens according to the present invention.

FIG. *2a* is an enlarged perspective view taken from FIG. 1, showing the top portion of the interlocked pan sections and battens.

FIG. *2b* is an enlarged perspective view similar to FIG. *2a*, but showing the bottom portion of the interlocked pan sections and battens and also showing in chain-dot lines the extensions of the pan sections before folding into interlocking with the extensions of the battens.

Figure 1:
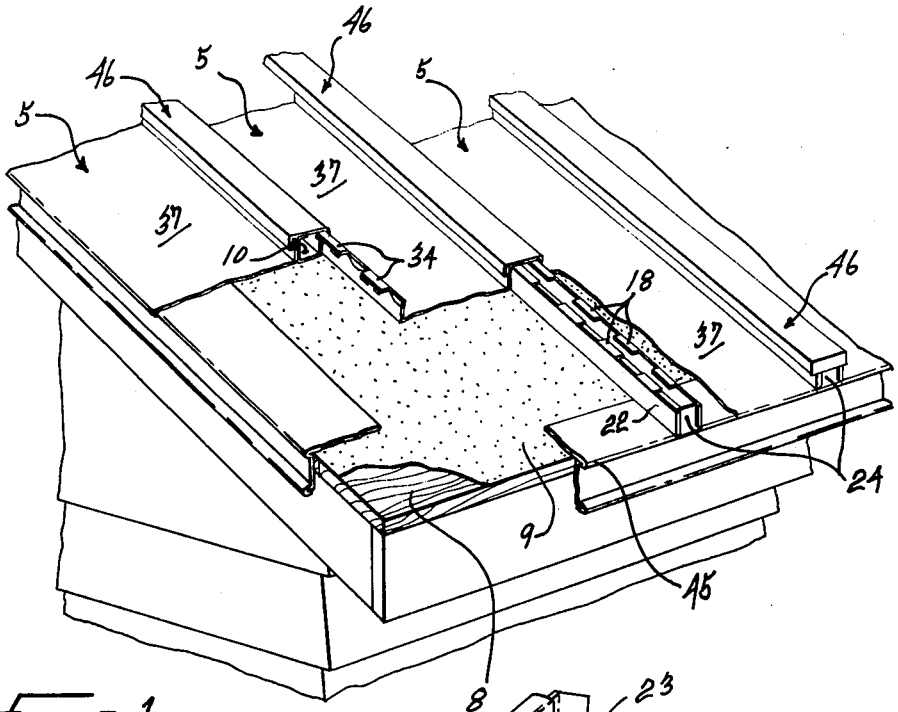

Referring to the drawings, the sheet metal roofing structure is formed of preformed pan sections 5, battens 6 and batten closure caps 7, all of which are interlocked with each other to provide a weatherproof roofing. The battens 6 are held down on the underlying wooden roof 8 and waterproof sheet, such as tar paper 9, by means of screws 10 passing through a bottom wall 14 of the battens 6.

Figure 6:
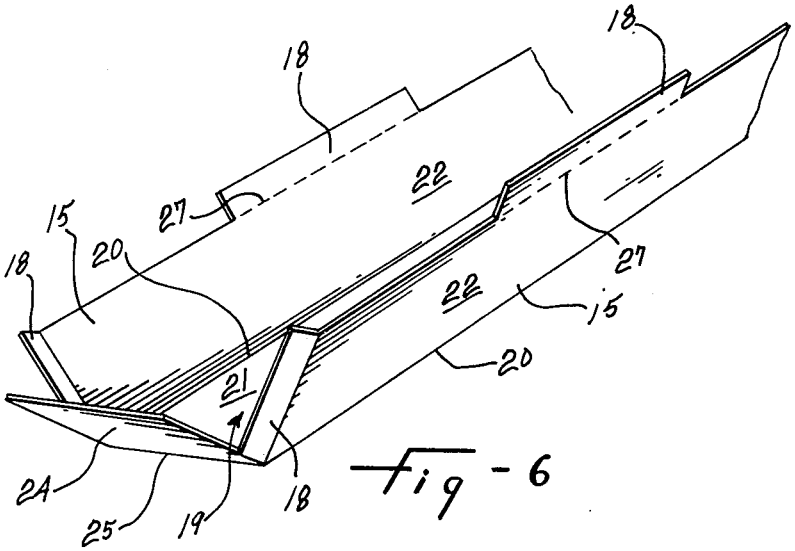
FIG. 6 is a perspective view of the batten as cut from the sheet of FIG. 5 with the batten partially folded.

The battens 6 are each formed from a sheet of metal 11 whose upper ends are at an angle cut along the solid lines 12, as shown in FIG. 6, and the shaded portions 13 are discarded. The bottom ends of the sheet 11 are cut along the solid lines 14 and the shaded corner portions 15 are discarded. The longitudinal side edges of the sheet 11 are cut along the solid lines 16 and the shaded portions 17 are discarded, leaving a series of side extensions 18 located at spaced intervals along the side edges of the sheet.

The remaining cut-out panel 19 is folded through 90° along the dotted lines 20 to form the bottom wall 21 and side walls 22 of the battens. The upper end portions of the side walls 22 have extended angular portions **22*a* and further extension portions 23 are provided which, in the assembled form of the roofing, engage with the side walls 22** of a batten on the opposite side of the roof to seal the top end of abutting battens at the ridge of the roof.

Figure 7:
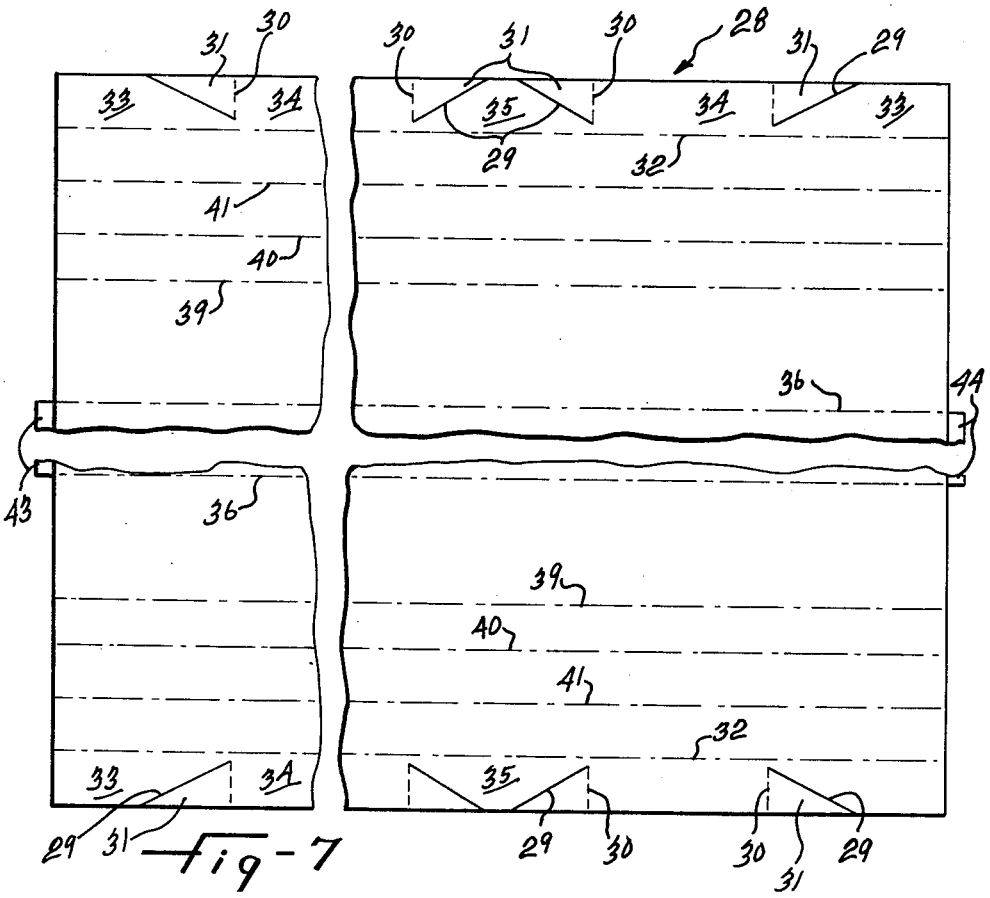
FIG. 7 is a partial plan view of the sheet from which the pan sections are formed, showing the cut and fold lines.

At the bottom end of the cut-out panel 19 the extension 24 of the batten wall 21 of the batten is folded upwards along the dotted line 25 to close the lower end of the batten, and the extensions 26 of the side walls 22 are folded along the dotted lines 27 to lie against the outer surface of the end extension 24 and thereby seal the side edges of the lower end 24 of the batten 6, as shown in FIG. 7.

The pan sections 5 are each formed from a sheet of metal 28 whose side edges are cut at an angle along the solid lines 29 and folded along the dotted lines 30 to form foldable triangular sections 31. The side edges of the sheet 28 are further folded along the dotted lines 32 to form foldable sections 33, 34 and 35. The sheet 28 is also folded along the dotted lines 36 to form the base portion 37 and side walls 38 of the pan sections.

Figure 2A:
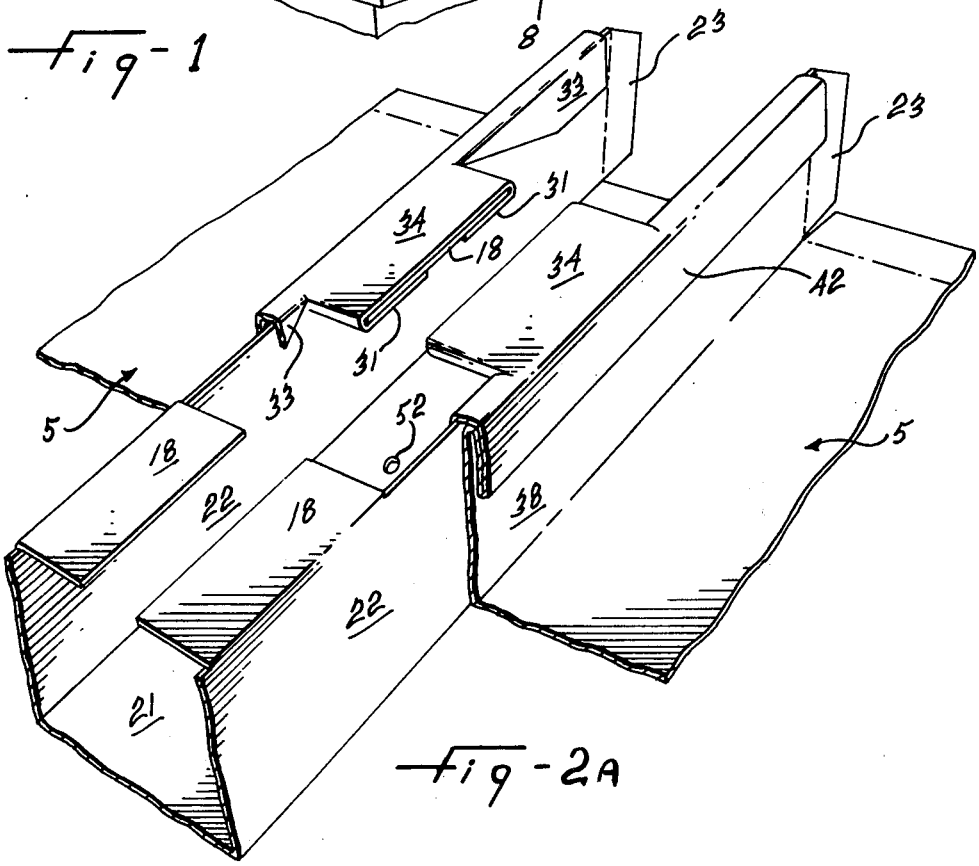
Figure 2B:
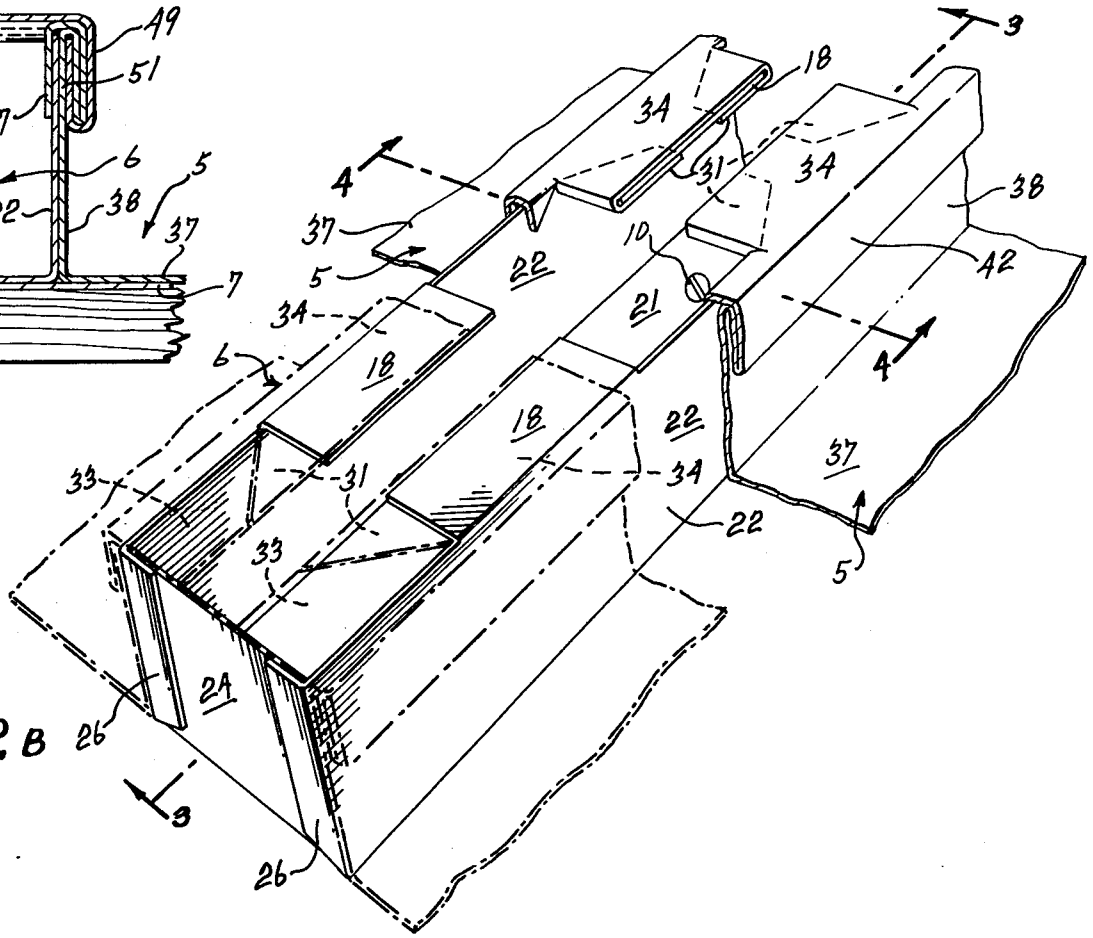
Figure 4:
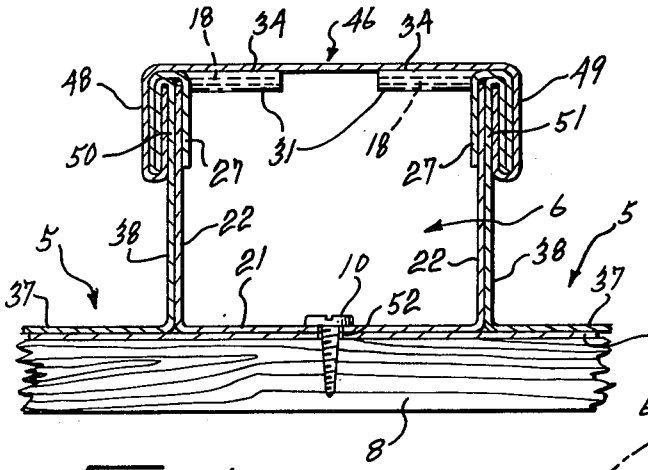
FIG. 4 is a transverse section taken on the line 4—4 of FIG. *2b*, including the batten enclosure cap engaged with the side walls of the pan sections.
Figure 3:
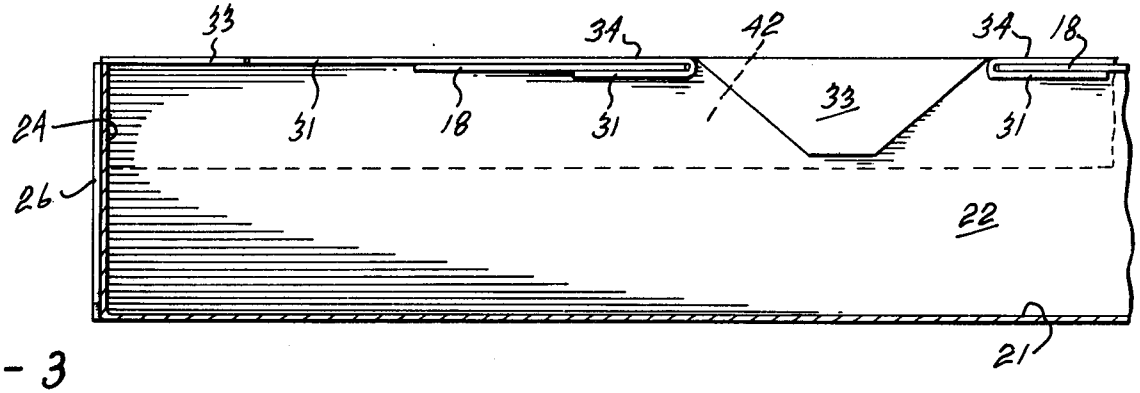
FIG. 3 is a longitudinal section taken on the line 3—3 of FIG. *2b*.
Figure 5:
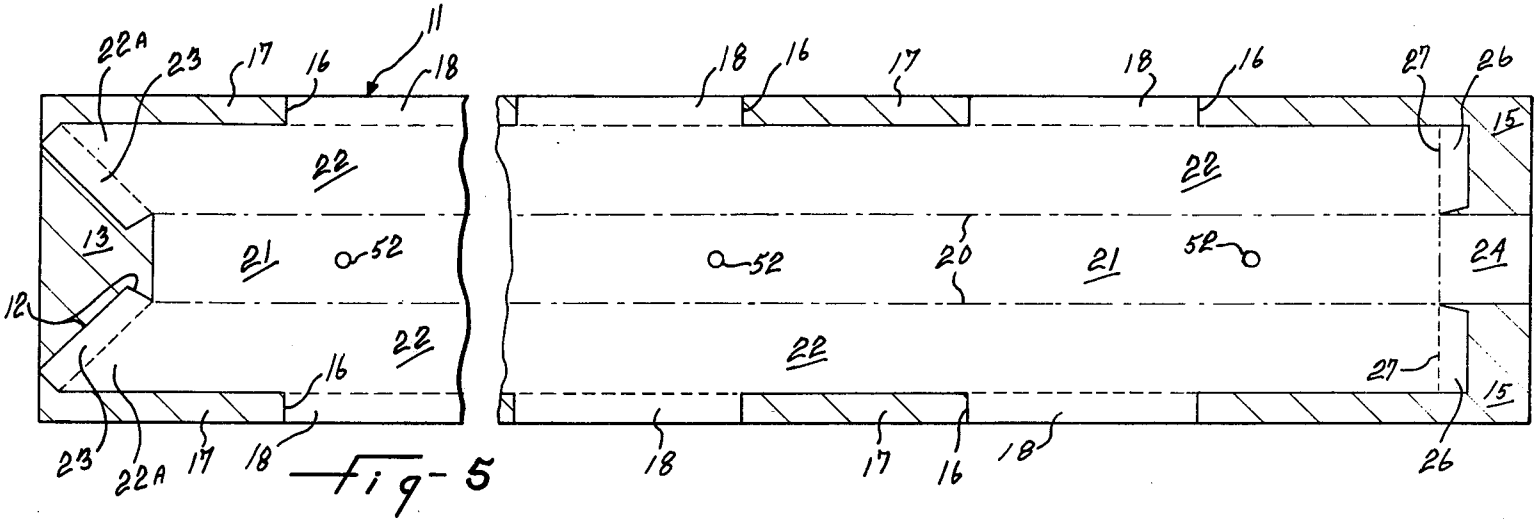
FIG. 5 is a partial plan view of the sheet from which the battens are formed, showing the cut and fold lines.

The side walls 38 are folded upon themselves along the lines 39, 40 and 41 to form double fold lips 42 depending from the top edge of the side walls 38 part way down the side walls 38, as clearly shown in FIG. 2.

The base portion 37 of the pan sections are provided with top and bottom extensions 43 and 44. The extension 43 at the top edge of the pan section on one side of the ridge of the roof is adapted to overlap the extension 43 and adjacent base portion 37 of the pan section on the other side of the ridge of the roof. The extensions 44 at the bottom edge of the pan sections are adapted to be folded over and under the roof surface starters 45.

The batten covering caps 46 are of sheet metal and comprise a top portion 47 lying over the associated battens 6, and two downwardly directed essentially vertical wings 48 and 49, each having an inner upwardly folded edge 50 and 51, are adapted to closely fit behind the depending double fold lips 42 of the pan sections on either side of each batten 6.

In the operation of this invention, the individual pan sections 5, battens 6 and batten covering caps 46 are preformed and the battens 6 are first arranged on the roof surface in parallel spaced apart arrangement vertically between the bottom edge of the roof and the ridge of the roof in the manner shown in FIG. 1 and are secured on the roof by the screws 10 passed through the punched or drilled holes 52 in the bottom wall 21 of the battens. The vertical top edges of adjacent battens at the ridge of the roof are sealed by the overlapped extension 23 of the side walls 22, while the vertical edges of the end wall 24 at the bottom end of the battens are sealed by the overlapped extensions 25 of the side walls 22.

With the battens 6 in place on the roof, the pan sections can now be slid upwards on the roof between pairs of battens, the side walls 38 in close parallel contact with the side walls 22 of the battens. At the same time, the sections 31, 33, 34 and 35 at the side edges of the pan sections slide over the top of the battens, specifically over the folded-in extensions 18 of the battens, until the side walls 38 of the pan sections completely overlie the side walls 22 of the battens. The unfolded sections 31 and 33 are shown in dotted lines in the lower portion of FIG. 2*b*.

In order to interlock the pan sections 5 with the battens 6, the extensions 33 of the pan sections are folded inwardly and downwardly into close contact with the inner surface of the side walls 22 of the battens, while the extensions 35 of the pan sections are similarly folded inwardly and downwardly.

In this alignment of the pan sections with the battens, the extensions 34 of the pan sections overlie the extensions 18 of the battens, with the triangular shaped extensions 31 extending beyond the end portions of the extensions 18. These triangular extensions 31 are now folded downwards and under the extensions 18. Thus, the pan sections are firmly interlocked with the battens against lateral or endwise movement while at the same time, the battens and pan sections reinforce each other and the whole roofing structure is held in place merely by the screws 52 which are readily accessible through the partially open top of the battens before the pan sections are put in place. As will be seen, the interlocking of the pan sections with the battens is accomplished by the interaction of the extensions to the top edges of the side walls 22 and 38 of the pan sections and battens.

Assembly of the roofing structure can now be completed by sliding the batten closure caps 46 upwards on the combined batten structure so that the wings 28 and 49 slide along the outer surface of the double fold lips 42, while the inner upwardly folded edges 50 and 51 tightly engage between the lips 42 and the adjacent side wall 38 of the pan sections and thus further adds to the strength of the battens.

A slight amount of lubricant greatly facilitates sliding of the pan sections on the battens and of the batten closure caps in place; a liquid which washes easily such as soap or detergent is preferred.

All exposed edges of the battens, pan sections and pan closure caps, such as the folded or lapped extensions 18 and 23 of the battens, can be sealed with a mastic compound.

The resulting roofing structure brought about by the fitting and interlocking of the three elements at the batten structure of the roofing ensures strength and stability of the roofing structure without these elements being held together by screws or other such fasteners, the only fasteners used being those holding down the battens on the underlying roof necessary to hold the battens in their aligned position while the other two elements of the roofing structure, the pan sections and the batten caps, are being manoeuvered into place and interlocked with the held-down battens.

The embodiments of the invention in which an exclusive property or privilege is claimed are defined as follows:

1. A metal roof structure of the batten type covering an underlying wooden roof structure comprising a series of battens of channel form having a bottom wall and a pair of side walls, the said side walls of the battens having a series of extensions at their upper edges, the said extensions being folded inwardly at right angles to the side walls, the said battens being disposed in spaced apart parallel arrangement on the said wooden roof structure, means to secure the bottom wall of the battens to said wooden roof structure, pan sections disposed between the said battens, the said pan sections having oppositely disposed side walls in contact with the side walls of the said battens and said pan sections having extension portions foldable to interlock with the extensions of the side walls of the battens so as to lock the pan sections to the battens, and a batten closure cap slidably engaged with each of said interlocked batten and pan sections.

2. A sheet metal roof structure of the batten type covering an underlying wooden roof structure comprising a series of battens of channel form having a batten wall and a pair of side walls, means to secure the said battens in spaced apart parallel arrangement on the underlying wooden roof structure, the said side walls of the battens having a series of spaced apart extensions folded inwardly of the side walls in a plane parallel with the bottom walls of the battens, prefolded pan sections having upstanding side walls adapted to lie in contact with the side walls of the said battens, the upper edge of the side walls of the battens having extensions, some of which are adapted to be folded over to engage with the adjacent side walls of the battens between the spaced apart extensions thereof and others of which are folded over to lie over and be folded under the spaced apart extensions of the side walls of the battens to lock the pan sections with the battens and batten closure caps adapted to slidably engage with the side walls of the pan sections and enclose the top surface of the battens.

3. A metal roof structure as set forth in claim 2 in which the spaced apart extensions of the side walls of the battens extend short of the longitudinal center line of the batten to leave a gap between extensions on the opposite sides of the batten and provide access to the means to secure the battens on the underlying roof structure.

4. A metal roof structure as set forth in claim 2 in which the means to secure the battens to the underlying wooden roof structure are a series of screws passed through the bottom wall of the battens and accessible through the gaps in the top portion of the battens.

5. A metal roof structure as set forth in claim 2 in which that portion of the side walls of the pan sections aligned between the extensions of the side walls of the battens are cut at an angle midway of their length inwardly towards that portion aligned with the extensions of the side walls of the battens and the cut angled portions adjacent to the extensions of the side walls of the battens are folded under the said latter extensions to secure against lateral movement of the pan sections relative to the battens.

6. A metal roof structure as set forth in claim 2 in which the upstanding side walls of the pan sections each have an inner, downwardly directed double fold lip extending parallel to the side wall and the batten closure cap is slidingly engaged with the said double fold to close the top of the battens.

7. A metal roof structure as set forth in claim 2 in which the battens have their bottom wall extended and folded upwards to form a lower end wall and the adjacent lower end of the side walls are extended and folded over the said end wall to seal the lower end of the batten.

8. A metal roof structure as set forth in claim 2 in which the upper end portions of the side walls of the battens are extended in triangular form beyond the adjacent end of the bottom wall and a further extension on the hypotenuse side of the extended triangular form of the side walls is adapted to seal the abutting upper ends of battens on opposite sides of a roof at the crest line of the roof.

* * * * *